US005929826A

United States Patent [19]

Shinkawa et al.

[11] Patent Number: 5,929,826

[45] Date of Patent: Jul. 27, 1999

[54] MOTOR DRIVEN ANTENNA APPARATUS FOR USE IN AUTOMOBILES

[75] Inventors: Masaki Shinkawa, Yamato; Toru Sasaki, Tokyo; Junichi Kawahata, Iwate-ken, all of Japan

[73] Assignee: Harada Industry Co., Ltd., Tokyo, Japan

[21] Appl. No.: 09/064,799

[22] Filed: Apr. 22, 1998

[30] Foreign Application Priority Data

Apr. 22, 1997 [JP] Japan ..... 9-104790

[51] Int. Cl.[6] ..... H01Q 1/10

[52] U.S. Cl. ..... 343/903; 343/840

[58] Field of Search ..... 343/903, 840, 343/725, 900, 715, 901, 711, 712; 310/62

[56] References Cited

U.S. PATENT DOCUMENTS 4,393,383 7/1983 Yamashita ..... 343/903
4,742,360 5/1988 Carolus et al. ..... 343/903
4,907,007 3/1990 Druecker et al. ..... 343/903
5,235,344 8/1993 Shinkawa et al. ..... 343/903
5,434,582 7/1995 Koike et al. ..... 342/702

*Primary Examiner*—Don Wong
*Assistant Examiner*—Kimnhung Nguyen
*Attorney, Agent, or Firm*—John P. White; Cooper & Dunham LLP

[57] ABSTRACT

A motor driven antenna apparatus for use in automobiles according to the present invention, includes a telescopic antenna mounted on the automobiles, a drive control mechanism for extending and retracting the telescopic antenna by a motor driven motor, a case for holding the drive control mechanism, a through-hole formed in a side wall of the case to make an inside and an outside of the case communicate with each other, and a duct having a first opening portion at one end and a second opening portion at other end, and attached to the case such that the first opening portion is connected to the through-hole outside the case and the second opening portion is formed outward below the through-hole. A foreign object blocking member is provided below the second opening portion and opposed to the second opening portion with a predetermined distance therebetween.

6 Claims, 4 Drawing Sheets

MOTOR DRIVEN ANTENNA APPARATUS FOR USE IN AUTOMOBILES

BACKGROUND OF THE INVENTION

The present invention relates to a motor driven antenna apparatus mounted on an automobile and, more particularly, to an improvement in a case for holding a drive control mechanism for controlling extension and retraction of an antenna.

The motor driven antenna apparatus used for automobiles usually includes a telescopic antenna, an antenna holding tube for insertably holding the antenna, and a drive control mechanism for controlling extension and retraction of the antenna, held in the antenna holding tube, by the power of a motor.

The drive control mechanism includes a motor control circuit, a motor driven motor which is rotated forward and backward by the motor control circuit, a rope transfer mechanism which is rotated by the motor driven motor, and a rope which is transferred in its longitudinal direction by the rope transfer mechanism to push the antenna out of the antenna holding tube and pull it thereinto. The rope is formed of, e.g., synthetic resin having moderate hardness and elasticity. The drive control mechanism, which is held in the case constituted of hard synthetic resin or the like, is attached to the lower end portion of the antenna holding tube.

The motor driven antenna apparatus having the above constitution is mounted on the body of an automobile in the following manner. A portion of the antenna holding tube, which is located near the upper open end thereof, is fixed into a mounting hole formed in the body wall of the automobile, and a lower portion of the antenna holding tube is fixed into the automobile. Thus, when the antenna is not used, it is pulled into the antenna holding tube and retracted. When the antenna is used, it is pushed out of the antenna holding tube and extended.

The motor driven antenna apparatus for use in automobiles is usually mounted on the right or left side of a rear trunk of an automobile. However, there have recently been increasing in cars having no trunks, such as an RV (recreational vehicle) and a wagon. In such a car, a motor driven antenna apparatus is often attached to the front fender of the car.

While the engine of the car is acting, the fender has a considerably high temperature inside due to heat generated from the engine. Thus, the motor driven antenna apparatus attached to the fender, especially the inside of the case housing the drive control mechanism and mounted in the fender is considerably increased in temperature. Under the flaming sun in midsummer, even though the engine of the automobile is stopped, the inside of the fender is greatly increased in temperature and so is that of the case.

If the high-temperature case is cooled suddenly by any cause, condensation will occur in the case.

In a commonly-known car, a drain is formed under the windshield and an outlet communicating with the drain is provided on the side of the fender. At the time of rainfall or car washing, water flows from the windshield to the drain and is then discharged through the outlet at a stretch. It is likely that the discharged water will partly splash the high-temperature case arranged near the outlet.

Since the discharged water cools the case suddenly, there occurs a difference in temperature between the inside and outside of the case and accordingly condensation will be generated inside the case.

The foregoing case has a sealed structure in which it is sealed with a waterproof seal member to prevent water from externally entering through a gap between the body and cover of the case.

If condensation occurs in the case and a water drop is attached to a metal member of the drive control mechanism, especially the motor control circuit on the substrate to which a +B power supply voltage is always applied, electrolytic corrosion will occur on, e.g., the wiring of the circuit and so will general corrosion, resulting in malfunction.

In the above-described prior art motor driven antenna apparatus for use in automobiles, there is a case where the drive control mechanism holding case of the sealed structure is heated to a considerably high temperature and cooled suddenly by rainwater, a splash of discharged water at the time of car washing, or the like. In this case, there occurs a wide difference in temperature between the inside and outside of the case, with the result that condensation is caused in the case and motor driven corrosion or general corrosion is caused, thereby causing a malfunction.

BRIEF SUMMARY OF THE INVENTION

An object of the present invention is to provide a motor driven antenna apparatus for use in automobiles wherein even though the apparatus is exposed to an environment whose temperature varies greatly, condensation is hardly caused in a case holding a drive control mechanism and thus neither electrolytic corrosion nor general corrosion is caused, with the result that the apparatus is operated without any malfunction.

To achieve the above object, a motor driven antenna apparatus for use in automobiles according to the present invention, has the following constructions. The other characteristic constructions will be described later in the embodiment of the present invention.

(1) A motor driven antenna apparatus for use in automobiles a telescopic antenna mounted on the automobiles; comprises a drive control mechanism for extending and retracting the telescopic antenna by a motor driven motor;

a case for holding the drive control mechanism;

a through-hole formed in a side wall of the case to make an inside and an outside of the case communicate with each other; and a duct having a first opening portion at one end and a second opening portion at other end, and attached to the case such that the first opening portion is connected to the through-hole outside the case and the second opening portion is formed outward below the through-hole.

(2) A motor driven antenna apparatus for use in automobiles a telescopic antenna mounted on the automobiles; comprises a drive control mechanism for extending and retracting the telescopic antenna by a motor driven motor;

a case for holding the drive control mechanism;

a through-hole formed in a side wall of the case to make an inside and an outside of the case communicate with each other;

a duct having a first opening portion at one end and a second opening portion at other end, and attached to the case such that the first opening portion is connected to the through-hole outside the case and the second opening portion is formed outward below the through-hole; and a foreign object blocking member provided below the second opening portion and opposed to the second opening portion with a predetermined distance therebetween.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiment

Figure 1:
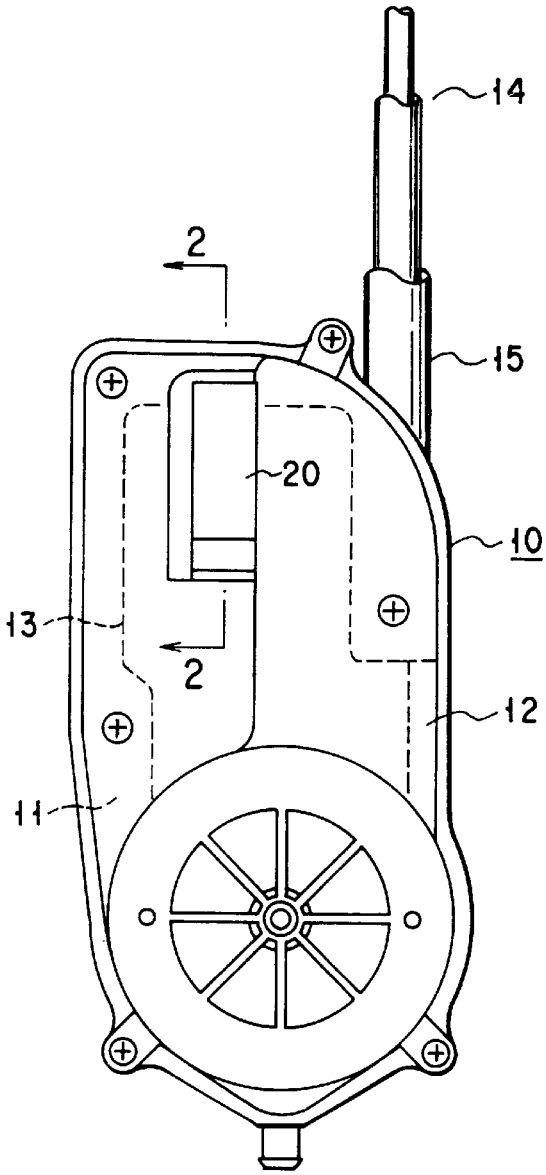
FIG. 1 is a front view of the constitution of the main part of a motor driven antenna apparatus for use in automobiles according to an embodiment of the present invention.
Figure 2:
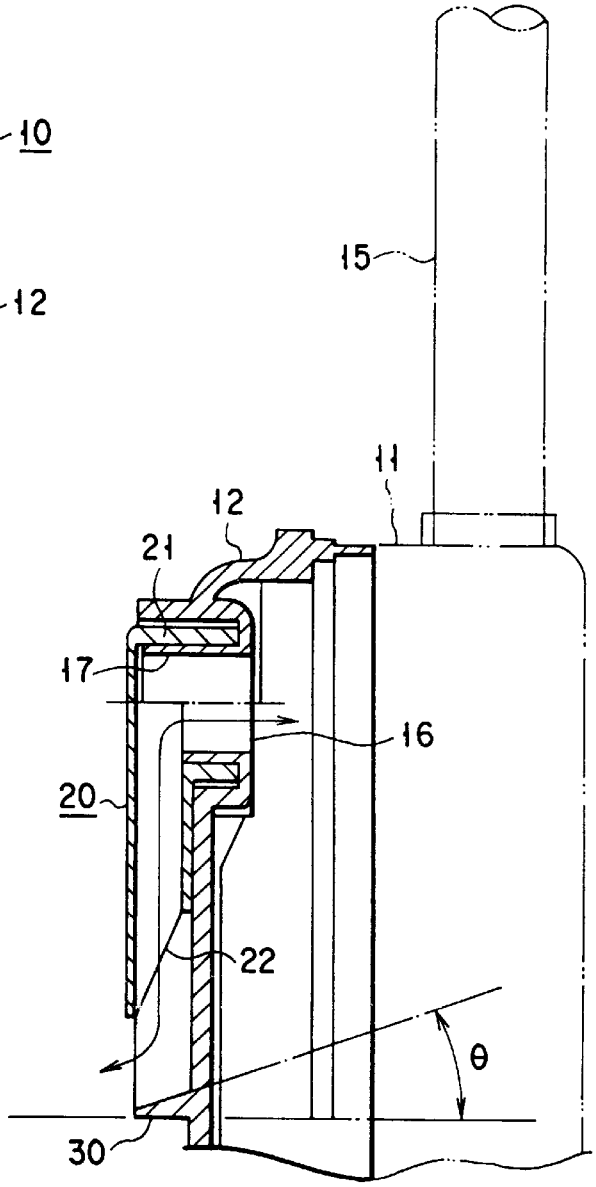
FIG. 2 is a cross-sectional view taken along line 2—2 of FIG. 1.

FIG. 1 is a front view of the constitution of the main part of a motor driven antenna apparatus for use in automobiles according to an embodiment of the present invention, which is viewed from a case cover. FIG. 2 is a cross-sectional view taken along line 2—2 of FIG. 1. In FIGS. 1 and 2, reference numeral 10 indicates a case for holding a drive control mechanism, which is formed of hard synthetic resin or the like. The case 10 includes a case body 11 and a case cover 12 which are formed integrally as one component.

A drive control mechanism (including a motor control circuit, a motor driven motor, a reduction gear, a rope transfer mechanism, a rope) 13 is included in the case 10 (mainly in the case body 11). The distal end portion of an antenna holding tube 15 is coupled to the upper end portion of the case body 11. The tube 15 is designed to insertably hold and support a telescopic antenna 14 constituted by slidably coupling a plurality of conductive pipes having different diameters.

The antenna 14 is thus extended and retracted by transferring an antenna driving rope, which is made of, e.g., synthetic resin having moderate hardness and elasticity, in its longitudinal direction in accordance with an operation of the drive control mechanism 13 and thus pushing the rope out of the holding tube 15 and pulling it thereinto.

A through-hole 16 for communicating with the inside and outside of the case 10, is formed at the upper portion of the side wall of the case cover 12. A cylindrical portion 17 is projected from the open end of the through-hole 16 outside the case 10, and a first opening portion 21 of a duct 20 is fixed on the outer circumference of the cylindrical portion 17. A second opening portion 22 of the duct 20 is formed downward below the through-hole 16 of the case 10. The duct 20 will be described in detail later.

A foreign object blocking member 30 is provided below the second opening portion 22 of the duct 20 so as to be opposed to the opening portion 22 with a predetermined interval.

The foreign object blocking member 30 is formed of part of the case cover 12 which is protruded. The face of the member 30, which is opposite to the second opening portion 22, is slanted gradually at an angle of θ as it moves away from the surface of the case so as to prevent water dropped from the second opening portion 22 from remaining on the inner surface of the member 30 (on the upper surface thereof in FIG. 2).

Figure 3:
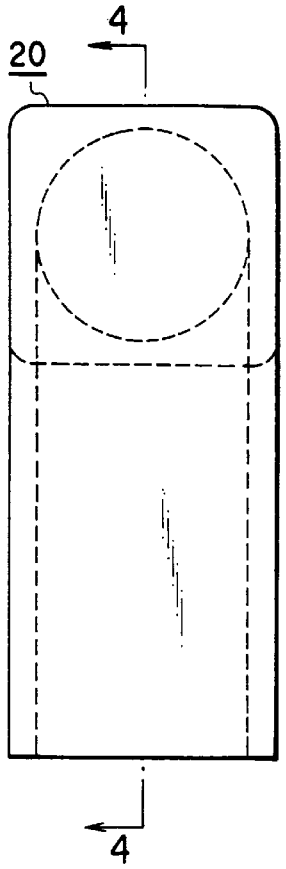
FIG. 3 is a front view of the constitution of a duct of the motor driven antenna apparatus according to the embodiment of the present invention.
Figure 4:
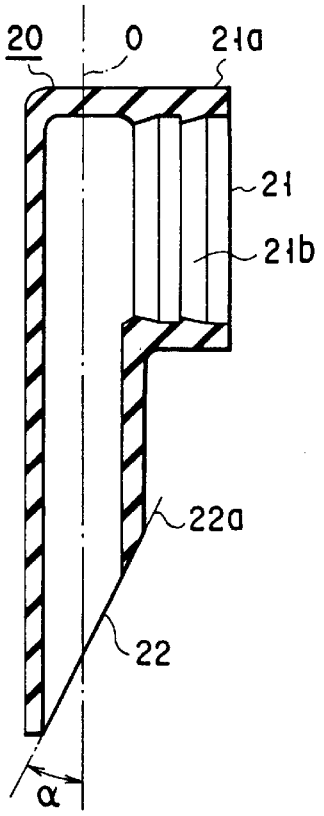
FIG. 4 is a cross-sectional view taken along line 4—4 of FIG. 3.

FIGS. 3 and 4 illustrate the constitution of the duct 20. The duct 20 is formed of a waterproof member having elasticity and made of rubber or soft resin. The first opening portion 21 is formed at one end of the duct 20, while the second opening portion 22 is formed at the other end thereof. The first opening portion 21 includes a short cylinder 21*a* extending in a direction perpendicular to the major axis θ of the duct 20, and a pleat portion 21*b* for preventing the duct from coming off is formed on the inner surface of the short cylinder 21*a*. The second opening portion 22 has a slant open face in which direction the short cylinder 21*a* extends, or an open face 22*a* which is slanted at an angle of a to the major axis θ.

The duct 20 so constituted can easily be attached to and integrally formed with the case 10 by fitting the first opening portion 21 onto the cylindrical portion 17 which is protruded from the end of the through-hole 16 of the case cover 12. The first opening portion 21 cannot easily be pulled out of the cylindrical portion 17 by the function of the pleat portion 21*b*, unless a specific pulling force is externally applied.

In the motor driven antenna apparatus of the above embodiment, the through-hole 16 is formed on the side wall of the case 10 holding the drive control mechanism 13, the first opening portion 21 of the duct 20 is joined to the open end of the through-hole 16 outside the case 10, and the second opening portion 22 is formed downward below the open end of the through-hole 16.

As indicated by the arrow in FIG. 2, the inside and outside of the case 10 communicate with each other through the duct 20. Therefore, even though the motor driven antenna apparatus is exposed to an environment whose temperature varies greatly, such as in the vicinity of an engine room of the fender of the automobile, a difference in temperature between the inside and outside of the case 10 is always maintained at a low value. Therefore, a water drop is hardly likely to adhere to a motor driven circuit such as a motor control circuit, and motor driven corrosion or general corrosion does not occur, nor does any malfunction due to such corrosion.

Moreover, the duct 20 is attached to the case 10 such that the second opening portion 22 is formed downward below the open end of the through-hole 16 outside the case and the first and second opening portions 21 and 22 are arranged to cross each other and communicate with each other through an L-shaped tube. Thus, even though water drops fall hard all over the duct 20, they are not likely to go up the duct 20 and enter the case 10 from the through-hole 16.

It has been confirmed by the experiments that it is effective to provide the through-hole 16 as high as possible above the case 10 in order to prevent condensation from occurring. Favorably, the through-hole 16 is located at least above the center of the case and in a position higher than that of the motor driven circuit of the motor control circuit.

It has also been confirmed by the experiments that the cross section of the duct 20 has to be larger than that (3.14 $mm^2$) of a tube whose inside diameter is 2 mm. In other words, it has been understood that if the inside diameter is 2 mm or less, the duct 20 will be covered with water drops at the time of condensation and thus an adequate effect cannot be obtained.

Since the foreign object blocking member 30 is provided below the second opening portion 22 of the duct 20, even though water drops or a cloud of sand jumps from below, it is blocked by the member 30 and it is unlikely that they will enter the duct 20.

Experimental Results

FIGS. 5 to 13 are views illustrating examples of experiments. In the experiments, in order to confirm the condensation preventing effect in the motor driven antenna apparatus of the above embodiment, the tests on temperature cycles of both the motor driven antenna apparatus of the present invention and the conventionally-used one (prior art) were carried out under the following conditions.

[Conditions]

(1) Humidity . . . 80%

Figure 5:
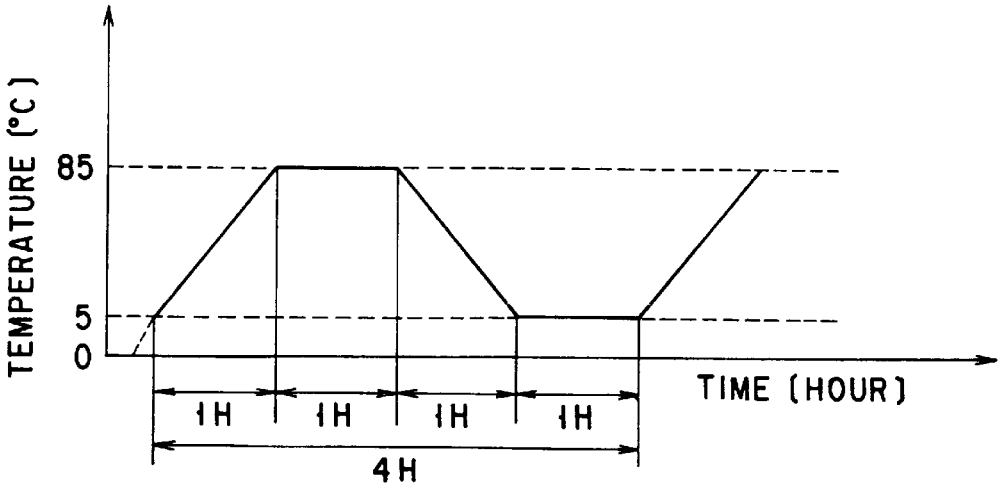
FIG. 5 is a view showing a temperature cycle for explaining the experiment of the motor driven antenna apparatus according to the embodiment of the present invention.

(2) Temperature Cycle . . . An operation of setting the atmosphere of an experimental room at a high temperature of 85° C. for an hour and setting it at a low temperature of 5° C. for an hour, every other hour, as shown in FIG. 5, is defined as one cycle. This operation is repeated for samples 1 and 2 (present invention) and samples 3 and 4 (prior art) by the following cycles.

Sample 1 (Present Invention) . . . 20 cycles

Sample 2 (Present Invention) . . . 35 cycles

Sample 3 (Prior Art) . . . 20 cycles

Sample 4 (Prior Art) . . . 35 cycles (3) Method of Checking Condensation

The actually-appearing condensation was photographed and the results were evaluated concerning the following four portions: portion A (shaded portion) indicating misty water drops, portion B (dotted portion) representing normal water drops, portion C (blacked portion) showing a puddle, and portion D (mesh portion) representing a rotten part.

[Experimental Results]

Figure 6:
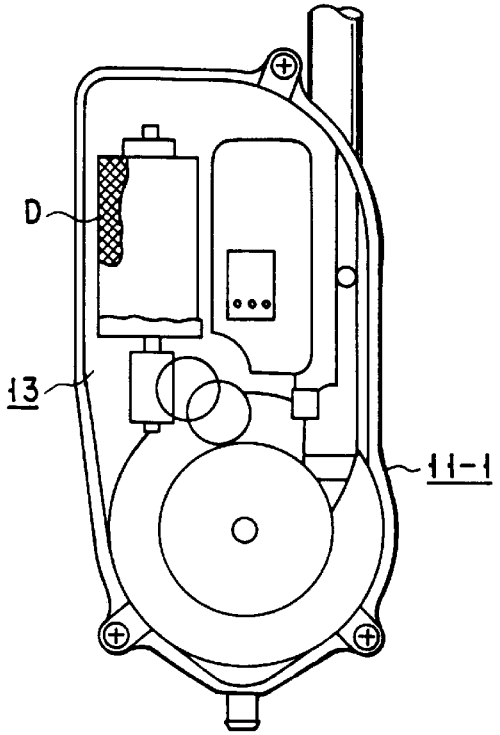
FIG. 6 is a view illustrating the condensation on the inner surface of a case body as an experimental result of "sample 1" prepared for the experiment of the motor driven antenna apparatus according to the embodiment of the present invention.
Figure 7:
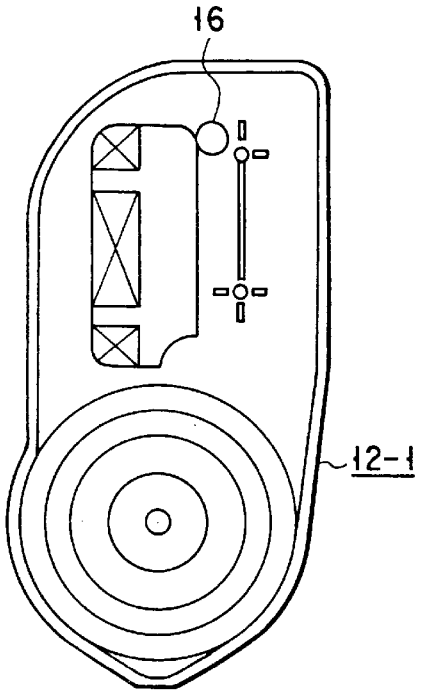
FIG. 7 is a view illustrating the condensation on the inner surface of a case cover as an experimental result of "sample 1" prepared for the experiment of the motor driven antenna apparatus according to the embodiment of the present invention.

FIGS. 6 and 7 are views of experimental results of sample 1. FIG. 6 shows the condensation on the inner surface of case body 11-1, while FIG. 7 does the condensation on the inner surface of case cover 12-1.

Figure 8:
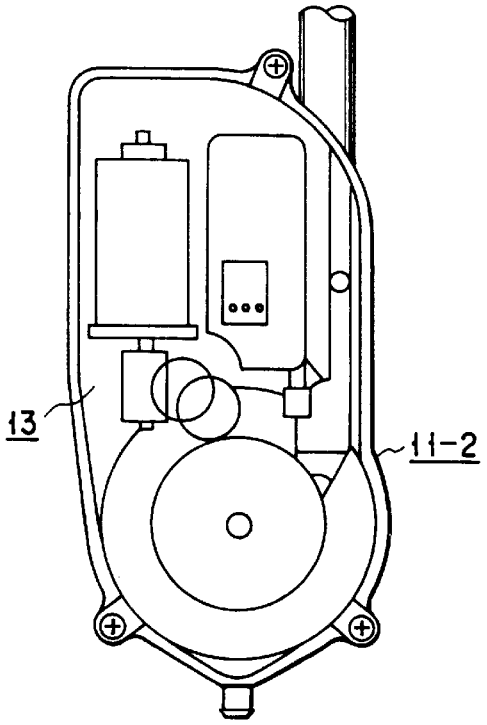
FIG. 8 is a view illustrating the condensation on the inner surface of the case body as an experimental result of "sample 2" prepared for the experiment of the motor driven antenna apparatus according to the embodiment of the present invention.
Figure 9:
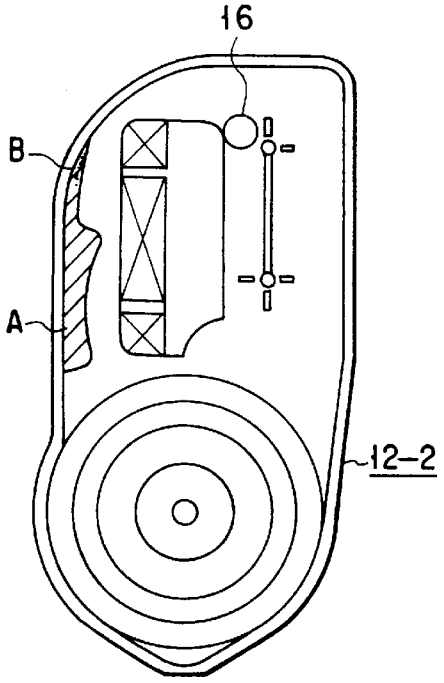
FIG. 9 is a view illustrating the condensation on the inner surface of the case cover as an experimental result of "sample 2" prepared for the experiment of the motor driven antenna apparatus according to the embodiment of the present invention.

FIGS. 8 and 9 are views of experimental results of sample 2. FIG. 8 shows the condensation on the inner surface of case body 11-2, while FIG. 9 does the condensation on the inner surface of case cover 12-2.

Figure 10:
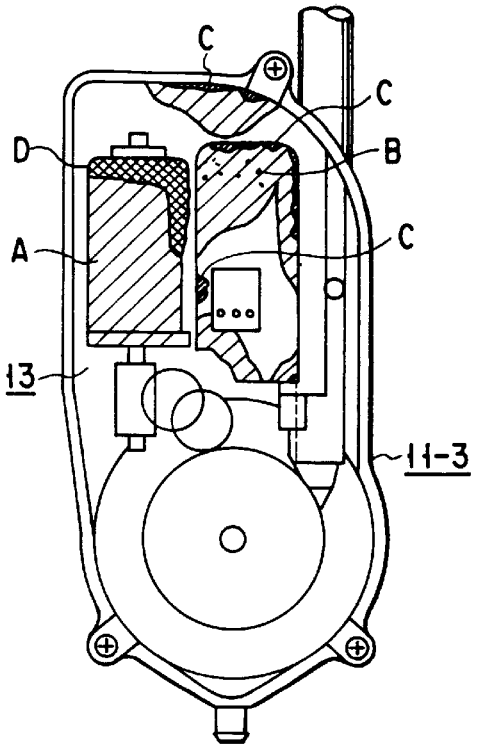
FIG. 10 is a view illustrating the condensation on the inner surface of a case body as an experimental result of "sample 3" prepared for the experiment of a prior art motor driven antenna apparatus for use in automobiles.
Figure 11:
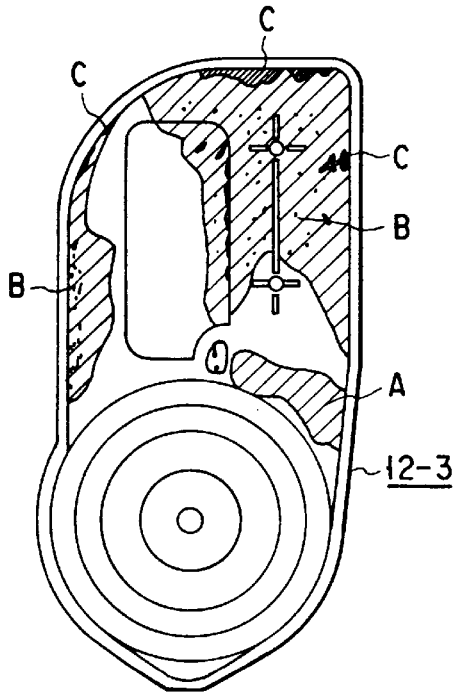
FIG. 11 is a view illustrating the condensation on the inner surface of a case cover as an experimental result of "sample 3" prepared for the experiment of the prior art motor driven antenna apparatus.

FIGS. 10 and 11 are views of experimental results of sample 3. FIG. 10 shows the condensation on the inner surface of case body 11-3, while FIG. 11 does the condensation on the inner surface of case cover 12-3.

Figure 12:
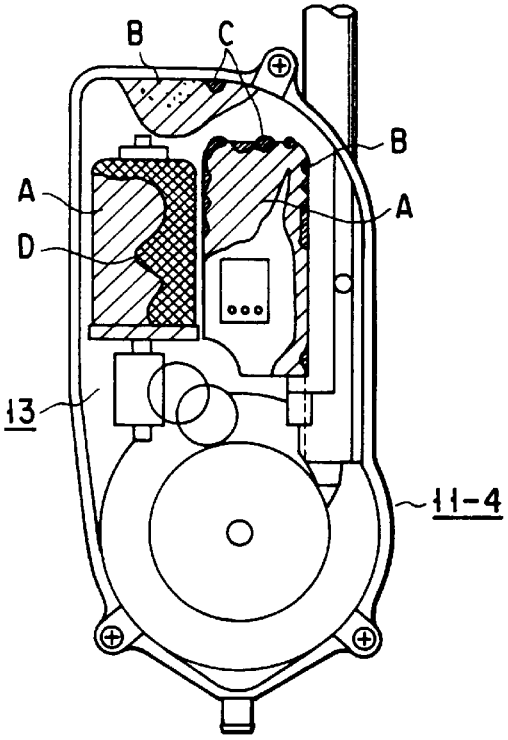
FIG. 12 is a view illustrating the condensation on the inner surface of the case body as an experimental result of "sample 4" prepared for the experiment of the prior art motor driven antenna apparatus.
Figure 13:
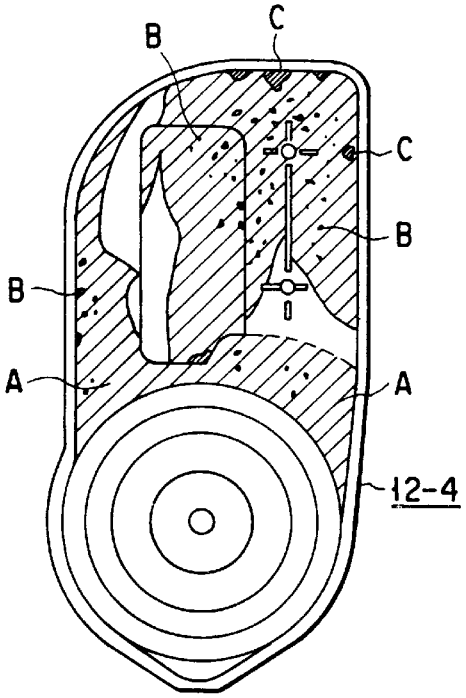
FIG. 13 is a view illustrating the condensation on the inner surface of the case cover as an experimental result of "sample 4" prepared for the experiment of the prior art motor driven antenna apparatus.

FIGS. 12 and 13 are views of experimental results of sample 4. FIG. 12 shows the condensation on the inner surface of case body 11-4, while FIG. 13 does the condensation on the inner surface of case cover 12-4.

[Evaluation]

According to samples 1 and 2 of the present invention, portion D was found in part of the motor and portions A and B were found in part of the case cover 12-2, but no water drops were adhered to the motor control circuit or the like, and it was confirmed that the present invention had a great condensation preventing effect on the whole. In contrast, portions A to D were mixed and found in samples 3 and 4 of the prior art and thus it was confirmed that condensation occurred.

(Modifications)

The motor driven antenna apparatus for use in automobiles according to the above embodiment, can be modified as follows:

i) The open face 22*a* is perpendicular to the major axis O.

ii) A plurality of ducts 20 are provided in the case 10.

iii) A foreign object blocking member 30 is formed independently and attached to the case 10.

iv) The duct 20 and foreign object blocking member 30 are formed integrally as one component.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A motor driven antenna apparatus for use in automobiles, comprising:

a telescopic antenna mounted on the automobiles;

a drive control mechanism for extending and retracting the telescopic antenna by a motor driven motor;

a case for holding the drive control mechanism;

a through-hole formed in a side wall of the case to make an inside and an outside of the case communicate with each other; and a duct having a first opening portion at one end and a second opening portion at other end, and attached to the case such that the first opening portion is connected to the through-hole outside the case and the second opening portion is formed outward below the through-hole.

2. The motor driven antenna apparatus according to claim 1, wherein the duct is formed of a waterproof member having elasticity, and the first opening portion is detachably fixed onto a cylindrical portion projected from an open end of the through-hole outside the case.

3. The motor driven antenna apparatus according to claim 1, wherein the second opening portion has an open face which is slanted and opposed to an outside surface of the case.

4. The motor driven antenna apparatus according to claim 1, wherein the duct has a section which is larger than that of a tube whose inside diameter is 2 mm.

5. A motor driven antenna apparatus for use in automobiles, comprising:

a telescopic antenna mounted on the automobiles;

a drive control mechanism for extending and retracting the telescopic antenna by a motor driven motor;

a case for holding the drive control mechanism;

a through-hole formed in a side wall of the case to make an inside and an outside of the case communicate with each other;

a duct having a first opening portion at one end and a second opening portion at other end, and attached to the case such that the first opening portion is connected to the through-hole outside the case and the second opening portion is formed outward below the through-hole; and a foreign object blocking member provided below the second opening portion and opposed to the second opening portion with a predetermined distance therebetween.

6. The motor driven antenna apparatus according to claim 5, wherein the foreign object blocking member is formed integrally with the duct as one component.

* * * * *